US006623183B2

(12) United States Patent
Nakagawa et al.

(10) Patent No.: US 6,623,183 B2
(45) Date of Patent: Sep. 23, 2003

(54) DEVELOPER PRODUCING EQUIPMENT AND METHOD

(75) Inventors: Toshimoto Nakagawa, Kawasaki (JP); Shu Ogawa, Tokyo (JP); Satoru Morita, Tokyo (JP); Makoto Kikukawa, Yokohama (JP); Takahiro Hozan, Tatsuno (JP)

(73) Assignee: Nagase & Co., Ltd., Osaka (JP)

( * ) Notice: Subject to any disclaimer, the term of this patent is extended or adjusted under 35 U.S.C. 154(b) by 0 days.

(21) Appl. No.: 10/068,809

(22) Filed: Feb. 6, 2002

(65) Prior Publication Data

US 2002/0146251 A1 Oct. 10, 2002

(30) Foreign Application Priority Data

Feb. 6, 2001 (JP) ..... 2001-029294

(51) Int. Cl.[7] ..... G03D 3/02; G03D 13/00

(52) U.S. Cl. ..... 396/578; 396/611; 396/626; 366/136; 137/3

(58) Field of Search ..... 396/578, 626, 396/611; 366/136, 152.4, 153.1, 160.1; 118/52, 54, 56, 319–321, 666–668; 427/240; 137/3, 88, 93

(56) References Cited

U.S. PATENT DOCUMENTS

| | | | | | |
|---|---|---|---|---|---|
| 5,223,881 | A | * | 6/1993 | Nakagawa et al. | 396/570 |
| 5,476,320 | A | * | 12/1995 | Taguchi et al. | 366/152.1 |
| 5,522,660 | A | * | 6/1996 | O'Dougherty et al. | 366/136 |
| 5,650,259 | A | | 7/1997 | Imai et al. | 430/258 |
| 5,924,794 | A | * | 7/1999 | O'Dougherty et al. | 366/136 |
| 5,965,329 | A | | 10/1999 | Sakaki et al. | 430/320 |
| 5,992,437 | A | * | 11/1999 | Takasaki et al. | 137/3 |
| 6,146,008 | A | * | 11/2000 | Laederich et al. | 366/136 |
| 6,340,559 | B1 | | 1/2002 | Su et al. | 430/331 |

FOREIGN PATENT DOCUMENTS

| | | | | |
|---|---|---|---|---|
| EP | 0 127 171 | | 12/1984 | G03F/7/26 |
| EP | 0 306 273 | | 3/1989 | G03F/7/10 |
| JP | 7-24289 | * | 1/1995 | |
| JP | 9-162094 | * | 6/1997 | |
| JP | 2751849 | | 2/1998 | B01F/15/04 |

OTHER PUBLICATIONS

Patent Abstracts of Japan, Publication No. 08–062852, Publication Date Mar. 8, 1996, 2 pages.

* cited by examiner

*Primary Examiner*—D. Rutledge
(74) *Attorney, Agent, or Firm*—Rosenthal & Osha L.L.P.

(57) ABSTRACT

The developer producing equipment of the present invention is connected via piping to working equipment in which electronic circuits, on which fine working is performed, are formed, and produces an alkali type developer used in the abovementioned working equipment. This developer producing equipment comprises a preparation tank to which a developer stock solution and pure water are supplied, and in which these are agitated, first liquid amount measuring means for measuring the amount of the alkali type developer inside the preparation tank, first alkali concentration measuring means for measuring the alkali concentration of the abovementioned alkali type developer, first liquid amount control means for adjusting the amount of the alkali type developer inside the preparation tank on the basis of the measured value obtained by the abovementioned first liquid amount measuring means the abovementioned first alkali concentration measuring means, and liquid supply control means.

21 Claims, 5 Drawing Sheets

DEVELOPER PRODUCING EQUIPMENT AND METHOD

BACKGROUND OF THE INVENTION

1. Field of the Invention

The present invention relates to developer producing equipment and a developer producing method, and more particularly to equipment which is connected via piping to working equipment in which electronic circuits are formed, on which fine working is performed and which manufactures an alkali type developer that is used to develop photoresists or the like in the abovementioned working equipment, and a method for manufacturing this alkali type developer.

2. Description of the Related Art

Generally, resist materials used in photolithographic processes in the manufacture of devices such as electronic devices or the like that have electronic circuits on which fine working is performed include positive type materials that are solubilized by exposure to light, and negative type materials that are insolubilized by exposure to light. As one example, in the manufacture of semiconductor devices, flat panel display (FPD) substrates and the like, such photo-etching is repeatedly performed; accordingly, mainly positive type resists are commonly used.

Aqueous solutions of inorganic alkalies consisting of sodium phosphate, caustic soda, sodium silicate or mixtures of these substances with other inorganic alkalies or the like may be cited as examples of developer materials for positive type resists. Furthermore, in cases where contamination by alkali metals is a concern, aqueous solutions of amine type organic alkalies that contain no metals, aqueous solutions of tetramethylammonium hydroxide (TMAH), aqueous solutions of trimethylmonoethanolammonium hydrochloride (choline) or the like are used. Among the latter materials, an aqueous solution of TMAH with a concentration of 2.38% are widely used.

Furthermore, developers prepared from these materials are used in large quantities in developing devices using a spray system, spin-coating system, dipping system or the like.

In developers used on photo-resists, the composition and concentration of the developer must be strictly controlled in order to obtain the maximum resolution, patterning sharpness (sharpness), stability and high yield in accordance with the developing process.

In particular, as the density of patterning has increased in recent years, there has been a demand for finer patterning widths. For example, in the case of semiconductor substrates, a demand has appeared for line widths on the 0.1 $\mu$m level; furthermore, in the case of flat panel display substrates, there is now a demand for line widths on the 1 $\mu$m level, and in the case of multi-layer printed circuit boards, there is a demand for line widths on the 10 $\mu$m level. Furthermore, there is now a demand for line widths of 1 $\mu$m or less in order to incorporate semiconductor circuits into flat panel display substrates using low-temperature polycrystalline silicon TFT techniques.

Consequently, there is a strong demand for improved precision of developer concentrations in order to reduce the variation in the effective sensitivity of photo-resists. For example, a range of values that deviate from the specified concentration by $\pm 1/1000$ or less is required as the control range of the developer concentration. Especially in the case of an aqueous solution of TMAH, a range of values that deviate from the specified concentration by $\pm 1/2000$ or less (for example, 2.380±0.001 wt %) is required.

Furthermore, in order to eliminate patterning defects, it is required that various developers contain extremely few particles, i.e. there must be 10 or fewer particles with a size of 0.1 $\mu$m or greater per milliliter of developer.

In recent years, moreover, there has been a further increase in the amount of developer used as a result of increased size and increased mass production of substrates.

Thus, along with a sharp demand for improved precision in developer concentrations and demand for particle-free developers, there has been a strong demand for measures to facilitate mass production and reduce cost.

In the case of conventional techniques, however, adjustment of the composition and concentration of developers in manufacturing plants for semiconductor devices and the like has been extremely difficult, not only in terms of equipment and operating costs, but also from the standpoint of sufficient control of the composition and concentration of the developers.

Accordingly, it has been unavoidably necessary in manufacturing plants for semiconductor devices and the like (hereafter referred to as the "use side") to use developers whose composition and concentration have been adjusted exclusively by the developer makers (hereafter referred to as the "supply side").

In such cases, a method is used in which a developer stock solution that has been prepared with a specified composition is diluted with pure water on the supply side, the developer thus adjusted to a specified concentration is placed in containers, and this adjusted developer is supplied to the use side.

In this case, the dilution factor of the developer stock solution varies according to the solution composition and stock solution concentration, the type of positive resist or the like that is the object of development, and the intended use. Ordinarily, the stock solution is diluted by approximately 8 to 40 times. Accordingly, the amount of developer prepared on the supply side is greatly increased in accordance with the dilution factor, thus resulting in an increase in the work involved in preparing containers and filling containers for the shipping of the developer to the use side, and an increase in shipping costs. As a result, such expenses account for a considerable portion of the cost of the developer.

Furthermore, a commensurate amount of time is required for shipping and storage until the developer prepared on the supply side can be used on the use side, and the developer deteriorates during this period.

Moreover, since developers tend to absorb carbon dioxide gas from the air, variations in concentration caused by the absorption of carbon dioxide gas occur during the dilution operation and the storage of the diluted developer even if a dilution apparatus is installed on the use side. This may also be cited as one of the reasons why the dilution of developers has not been performed on the use side in semiconductor device manufacturing plants or the like.

In order to solve these problems, a developer dilution apparatus comprising an agitating tank into which a photo-resist alkali type developer stock solution and pure water are introduced and subjected to forced agitation for a specified period of time, conductivity measuring means for extracting a portion of the mixture in the agitating tank, measuring the conductivity of this mixture and then returning the mixture to the agitating tank, control means for controlling either the photo-resist alkali type developer stock solution or pure water that is supplied to the agitating tank on the basis of the output signal from the conductivity measuring means, a storage tank into which the mixture from the agitating tank is introduced, and in which this mixture is stored, and nitrogen gas sealing means for sealing the agitating tank and storage tank with nitrogen gas, is disclosed in Japanese Patent No. 2751849.

This apparatus makes it possible to prepare the developer on the use side by mixing the developer stock solution and pure water. As a result, problems in terms of the control of the composition and concentration of the developer, and the conventional problem of increased shipping cost of the developer, are more or less solved.

In recent years, however, in response to market demands, it has become necessary to manufacture various types of substrates and the like in small lots. Accordingly, it has become necessary to install a plurality of substrate manufacturing apparatuses on the use side in order to handle such manufacture of various types of substrates in small lots, and to operate these apparatuses simultaneously. In some cases, furthermore, the concentrations of the developers used in these respective apparatuses vary over a broad range, e.g., from 0.1% to 2.5%, so that developers of various concentrations must be prepared for each use.

SUMMARY OF THE INVENTION

Accordingly, the present invention was devised in light of the abovementioned facts; it is an object of the present invention to provide developer producing equipment and a developer producing method which make it possible to produce a developer on the use side with a prescribed concentration from a developer stock solution quickly and with good precision, and which can sufficiently handle the manufacture of various types of substrates in small lots, and to control the composition and concentration of the developer that is produced with good precision.

In order to solve the abovementioned problems, the developer producing equipment of the present invention is equipment which is connected via piping to working equipment in which electronic circuits are formed, on which fine working is performed, and which produces an alkali type developer that is used in this working equipment, and comprises: a preparation tank to which a developer stock solution and pure water are supplied and subjected to agitation, and in which an alkali type developer is prepared; first liquid amount measuring means for measuring the amount of alkali type developer in the preparation tank; first alkali concentration measuring means for measuring the alkali concentration of the alkali type developer in the preparation tank; first liquid amount control means for adjusting the amount of alkali type developer in the preparation tank on the basis of the measured value obtained by the first liquid amount measuring means and the measured value obtained by the first alkali concentration measuring means; and liquid supply control means for adjusting the amount of developer stock solution that is supplied to the preparation tank or the amount of pure water that is supplied to the preparation tank, or both, on the basis of the measured value obtained by the first liquid amount measuring means and the measured value obtained by the first alkali concentration measuring means.

In the developer producing equipment constructed in this manner, the developer stock solution is diluted with pure water in the preparation tank so that a developer is prepared. At this time, the amount of liquid in the preparation tank and the concentration of the alkali constituting the developer component in the preparation tank are measured, and the liquidity is adjusted by the first liquid amount control means and the liquid supply control means on the basis of these measurements so that the developer has the desired concentration. Accordingly, the concentration can be adjusted quickly and easily, and concentration control can be accomplished with good precision.

Furthermore, since the developer thus prepared with the desired concentration can be supplied to working equipment via piping, separate piping or shipping costs are eliminated. Moreover, if the developer preparation apparatus, including the piping connected to the working equipment, is constructed as a system that is substantially sealed off from the atmosphere, deterioration of the developer caused by the absorption of carbon dioxide gas and the like in the atmosphere by the developer can be suppressed.

Furthermore, it is desirable that the developer producing equipment of the present invention be equipped with a leveling tank which is disposed between the preparation tank and the abovementioned working equipment, and which evens out the alkali concentration of the alkali type developer. If this is done, the alkali concentration in the developer, which has a slight error that is unavoidably generated, can be evened out so that the precision of the developer concentration is greatly improved.

In concrete terms, the leveling tank is equipped with second liquid amount measuring means for measuring the amount of alkali type developer in the leveling tank.

Furthermore, it is desirable that the leveling tank be equipped with second alkali concentration measuring means for measuring the alkali concentration of the alkali type developer in the leveling tank.

Moreover, it is ideal if the leveling tank is equipped with second liquid amount control means for adjusting the amount of alkali type developer in the leveling tank on the basis of the measured value obtained by the second liquid amount measuring means and the measured value obtained by the second alkali concentration measuring means.

Furthermore, it is desirable that circulation feeding piping that feeds the alkali type developer in the leveling tank back into the preparation tank be provided.

More concretely, the leveling tank is equipped with an agitation mechanism that agitates the alkali type developer in the leveling tank.

Even more concretely, the leveling tank is equipped with a filtration mechanism that filters the alkali type developer in the leveling tank.

More concretely still, it is useful if liquid feed/liquid surface level control means for feeding the alkali type developer into the abovementioned leveling tank from the preparation tank and adjusting the liquid surface level of the alkali type developer in the preparation tank and the liquid surface level of the alkali type developer in the leveling tank are provided. These liquid surface levels are adjusted to arbitrary levels; however, it is useful if both levels are adjusted so that these levels are substantially the same.

In this case, it is even more desirable if the liquid feed/liquid surface level control means have communicating piping which is connected to the preparation tank and leveling tank, and which is such that the alkali type developer is naturally fed into the leveling tank from the preparation tank.

Moreover, it is desirable that a storage tank which is disposed between the leveling tank and the working equipment, and which stores the alkali type developer, be provided.

Moreover, it is even more desirable if the developer producing equipment is equipped with wet nitrogen sealing means for sealing the preparation tank and leveling tank with wet nitrogen gas.

A system which has a plurality of preparation tanks is also useful.

Alternatively, the preparation tank and leveling tank may also be constructed as an integral unit.

Furthermore, it is even more useful if fine particle number measuring means that measure the number of fine particles contained in the alkali type developer in the state prior to supply thereof to the working equipment are provided.

Even more preferably, dissolved gas removal means that remove the dissolved gas contained in the alkali type developer are provided.

It is especially desirable that the first liquid amount measuring means measure either the volume or the weight of the alkali type developer, or both.

Alternatively, it is also desirable that the first alkali concentration measuring means be at least one of the following devices: a conductivity meter, an ultrasonic concentration meter, a liquid density meter or an automatic titration device.

Similarly, it is desirable that the second alkali concentration measuring means be at least one of the following: a conductivity meter, an ultrasonic concentration meter, a liquid density meter or an automatic titration device.

More concretely, the developer stock solution has a discretionary alkali concentration selected from a specified range of alkali concentrations.

Furthermore, the developer producing method of the present invention is a method that produces an alkali type developer that is supplied via piping to a working process that forms electronic circuits on which fine working is performed, comprising the steps of preparing an alkali type developer by agitating a developer stock solution and pure water, measuring the amount of the alkali type developer, measuring the alkali concentration of the alkali type developer, adjusting the amount of the alkali type developer on the basis of the measured value of the liquid amount of the alkali type developer and the measured value of the alkali concentration of the alkali type developer, and adjusting either the amount of developer stock solution that is supplied to the step of preparing the alkali type developer or the amount of the abovementioned pure water that is supplied to the step of preparing the alkali type developer, or both, on the basis of the measured value of the liquid amount of the alkali type developer and the measured value of the alkali concentration of the alkali type developer.

DESCRIPTION OF THE PREFERRED EMBODIMENTS

Figure 1:
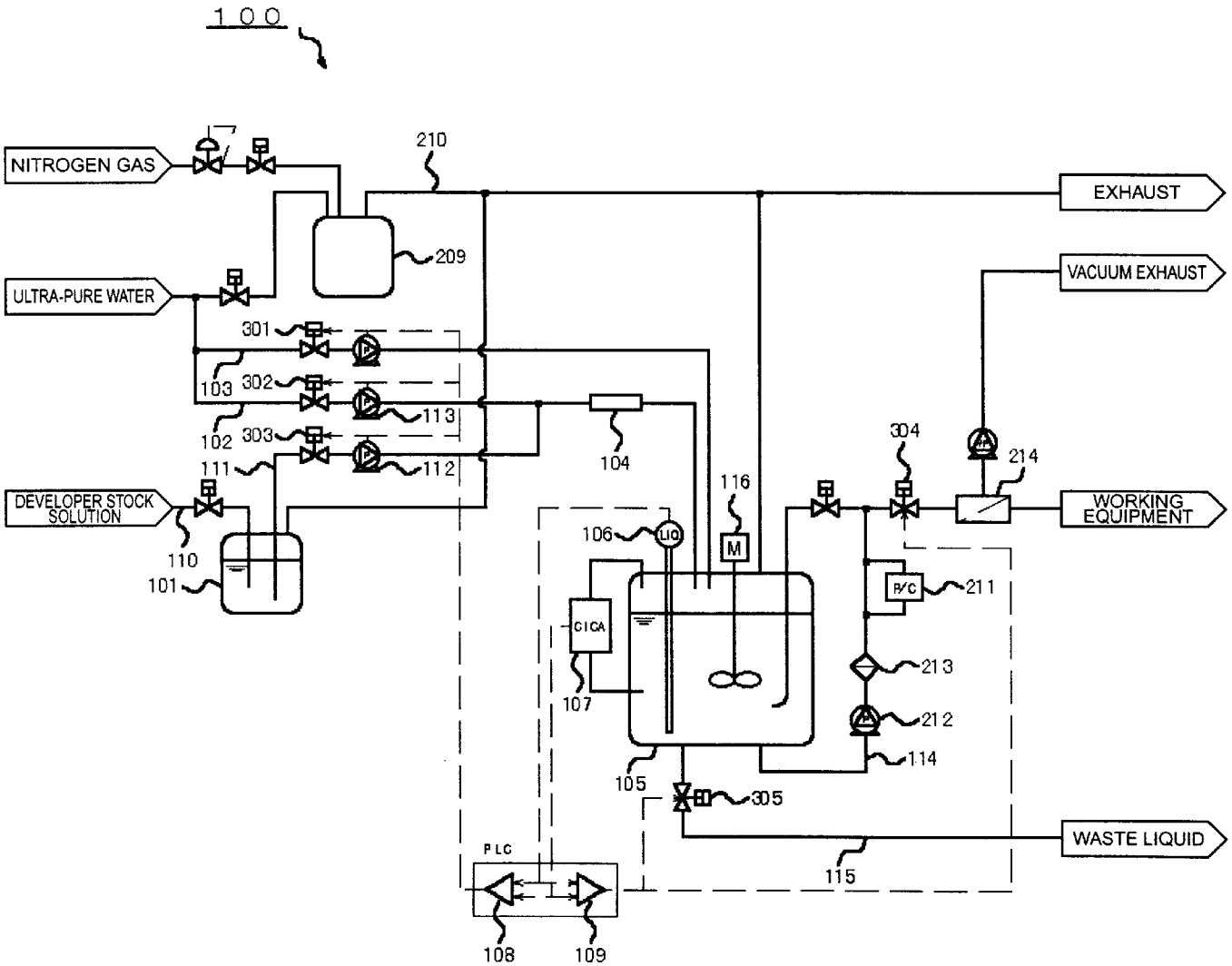
FIG. 1 is a system diagram which shows the construction of a first embodiment of the developer producing equipment of the present invention in model form.

Embodiments of the present invention will be described in detail below. Furthermore, the same elements are labeled with the same symbols, and redundant descriptions are omitted. Moreover, unless otherwise specifically noted, the positional relationships are based on the positional relationships shown in the figures. In addition, the dimensional proportions of the figures are not limited to the proportions shown in the figures.

As was described above, FIG. 1 is a system diagram which shows the construction of a first embodiment of the developer producing equipment of the present invention in model form.

The developer producing equipment 100 is equipped with a developer stock solution tank 101 in which a developer stock solution is stored, and a preparation tank 105 to which a pure water supply system is connected. A developer stock solution is stored in the developer stock solution stank 101, and the system is arranged so that the developer stock solution in the developer stock solution tank 101 is replenished via piping 110 having a flow rate regulating valve on the basis of command values from a liquid level gauge not shown in the figures.

Furthermore, piping 111 which has a flow rate regulating valve 303 and a pump 112 is connected to the developer stock solution tank 101. This piping 111 is connected to pure water supply piping 102 which has a line mixer 104 and which is attached to the pure water supply system, with this connection of the piping 111 being located on the upstream side of the line mixer 104. As a result of the operation of the pump 112, the developer stock solution in the developer stock solution tank 101 flows from the piping 111, flows together with pure water supplied by the operation of the pump 113 inside the pure water supply piping 102 (which has a flow rate regulating valve 302 and pump 113), and is further mixed by the line mixer 104, after which this mixture is fed into the preparation tank 105.

Furthermore, pure water supply piping 103 which has a flow rate regulating valve 301 and a pump, and which is connected to the preparation tank 105, branches from the pure water supply piping 102, and is arranged so that pure water can be supplied alone to the preparation tank 105.

Here, examples of the developer stock solution used in the present invention include aqueous solutions of inorganic alkalies such as sodium phosphate, caustic soda, sodium silicate or mixtures of these compounds with other inorganic alkalies or the like. Furthermore, in cases where contamination by alkali metals is a concern, a powerful metal-free amine type alkali aqueous solution, aqueous solution of TMAH, aqueous solution of choline or the like is useful.

Meanwhile, the pure water used in the present invention may be pure water that is used in electronic circuit board manufacturing plants or the like in which alkali type developers are required. In such manufacturing plants or the like, large quantities of pure water are required; accordingly, a pure water manufacturing apparatus tends to be viewed as a necessary piece of equipment. Consequently, pure water for the manufacture of the alkali type developer required in the present invention is relatively easy to obtain on the supply side.

Furthermore, additives may be appropriately added to the alkali type developer as required. Examples of such additives include surfactants and the like. Furthermore, in cases where additives are added, additive tanks may also be installed.

Furthermore, the preparation tank 105 is equipped with agitating means 116 (an agitation mechanism), and has liquid amount measuring means 106 (first liquid amount measuring means) and alkali concentration measuring means 107 (first alkali concentration measuring means) that are connected to a control system which has liquid amount control means 108 (first liquid amount control means) and liquid supply control means 109.

The agitating means 116 are used to forcibly agitate the mixture consisting of the developer stock solution and pure water that fed from the line mixer 104. Here, the method that is used to agitate the mixture is, for example, agitation by means of agitating vanes or circulation type agitation in which the mixture is cause to circulate through the preparation tank 105. Furthermore, in the case of circulation type agitation, if the discharge direction of the nozzle that is used to discharge the circulating liquid again into the preparation tank 105 is disposed so that the mixture rotates in the direction of the inner circumference of the preparation tank 105, a jet stream rotation type agitating action can be performed. The agitating means 116 are means that can realize one of the abovementioned agitation methods.

Furthermore, the liquid amount measuring means 106 are means that are used in order to measure and control the amount of alkali type developer inside the preparation tank 105. For example, the measurement of the liquid amount is accomplished by measuring either the volume or the weight of the alkali type developer, or both.

Furthermore, the term "control of the liquid amount" used here refers to control of the amount by which the alkali type developer is diminished when the alkali type developer in the preparation tank 105 is diminished as a result of use, and control of the amount by which the alkali type developer is forcibly reduced when the alkali type developer is forcibly reduced to a specified amount (the same is true of the "control of the liquid amount" in the leveling tank 202 described later).

Furthermore, the alkali concentration measuring means 107 are means that are used to measure and control the alkali concentration of the alkali type developer in the preparation tank 105. Examples of such alkali concentration measuring means 107 include a conductivity meter, an ultrasonic concentration meter, a liquid density meter and an automatic titration device or the like.

Any of these devices may be used; however, the use of a conductivity meter is especially desirable. In this case, if the relationship between the conductivity of the alkali type developer and the concentration of the alkali type developer at a preset reference temperature and the temperature coefficient of the conductivity of the alkali type developer in the vicinity of the reference temperature are determined, a developer with a desired concentration can be manufactured easily and with good precision.

Furthermore, the alkali concentration measuring means 107 may also be installed outside the preparation tank 105 as shown in FIG. 1, and it is desirable that the measuring means 107 be installed so that the electrode parts are disposed inside the preparation tank 105, thus allowing direct measurement of the alkali concentration of the alkali type developer inside the preparation tank 105.

Meanwhile, the liquid amount control means 108 are used to perform specified calculations on the basis of the measurement signals from the liquid amount measuring means 106 and alkali concentration measuring means 107, and are further used to control the amount of alkali type developer inside the preparation tank 105 to a specified amount on the basis of the results of these calculations.

In concrete terms, for example, when an alkali type developer with a concentration differing from that of the alkali type developer used in the electronic circuit board developing process is to be produced (manufactured) as required, the amount by which the alkali type developer in the preparation tank 105 must be reduced in order to adjust the alkali type developer to the desired concentration is calculated from the output signal of the liquid amount measuring means 106 and the output signal of the alkali concentration measuring means 107. Then, the amount of alkali type developer in the preparation tank 105 is reduced on the basis of this calculated value.

In this case, the alkali type developer that is discharged from the preparation tank 105 may be fed into an electronic circuit board developing process using an alkali type developer of this concentration via piping 114 that connects the preparation tank 105 and the working equipment, or may be discharged to the outside of the equipment-via drain piping 115 which has a flow rate regulating valve 305 and which is connected to the preparation tank 105. Considering the effect on the environment, it is desirable that this alkali type developer be fed into a developing process in the working equipment.

Furthermore, the liquid supply control means 109 are means that control either the amount of developer stock solution that is supplied to the preparation tank 105 or the amount of pure water that is supplied to the preparation tank 105, or both, on the basis of the measurement signals from the liquid amount measuring means 106 and the alkali concentration measuring means 107.

In concrete terms, these liquid supply control means 109 control either the amount of developer stock solution that is supplied to the preparation tank 105 or the amount of pure water that is supplied to the preparation tank 105, or both, at the time of the initial preparation of the alkali type developer, at the time of a subsequent preparation of the alkali type developer when the supply of alkali type developer has diminished as a result of use, or at the time of preparation of an alkali type developer with a different alkali concentration following the forcible reduction of the amount of alkali type developer by the liquid amount control means 108.

One example of the developer producing method of the present invention using the developer producing equipment 100 constructed as described above will be described below.

First, during the preparation of the solution in the empty preparation tank 105, the liquid amount measuring means 106 detect that the [preparation tank 105] is "empty". Afterward, the pump 112 and pump 113 are operated by a command signal outputted from the liquid amount measuring means 106, so that a mixture consisting of the developer stock solution and pure water is fed into the preparation tank 105. Next, this mixture is agitated by the agitating means 116, so that the alkali concentration in this state is roughly evened out. During this period, the liquid amount of the mixture inside the preparation tank 105 is measured by the liquid amount measuring means 106. At the same time, the alkali concentration of the mixture is measured by the alkali concentration measuring means 107.

Signals indicating these measured values are respectively outputted from the liquid amount measuring means 106 and alkali concentration measuring means 107, and inputted into the liquid supply control means 109. On the basis of these measurement signals, the liquid supply control means 109 performs calculations that calculate the amount of developer stock solution and/or pure water that is to be supplied to the preparation tank 105 in order to prepare an alkali type developer of the desired concentration.

Next, a signal indicating the results of these calculations is sent from the liquid supply control means 109 to at least one of the flow rate regulating valves 301, 302 and 33, and the specified valve is opened for a fixed period of time at a specified degree of opening in accordance with this command. As a result, a specified amount of developer stock solution or pure water, or both, is supplied to the preparation tank 105, and an alkali type developer with the desired concentration is prepared.

A method for preparing an alkali type developer which has a concentration that differs from that of the existing alkali type developer will be described below as another example. In this case, for example, the desired alkali concentration is input into the liquid supply control means 109 beforehand. Then, first of all, measurement of the liquid amount of the existing alkali type developer inside the preparation tank 105 is performed by the liquid amount measuring means 106, and measurement of the alkali concentration of the existing alkali type developer is performed by the alkali concentration measuring means 107.

Signals indicating these measured values are respectively outputted from the liquid amount measuring means 106 and the alkali concentration measuring means 107, and inputted into the liquid amount control means 108. On the basis of these measurement signals, the liquid amount control means 108 perform calculations that calculate the liquid amount by which the existing alkali type developer is to be reduced (i.e., the liquid amount that is to be discharged from the preparation tank 105) in order to prepare an alkali type developer of the desired concentration.

Next, a signal indicating the results of these calculations is sent from the liquid amount control means 108 to the flow rate regulating valve 304 and/or flow rate regulating valve 305, and the specified flow rate regulating valve is opened for a fixed period of time at a specified degree of opening in accordance with this command. As a result, a specified amount of the existing alkali type developer is discharged from the preparation tank 105, so that the amount of liquid in the preparation tank 105 is reduced.

Then, at least one of the flow rate regulating valves 301, 302 and 303 is opened for a fixed period of time at a specified degree of opening in accordance with the output signal from the liquid supply control means 109, so that the developer stock solution and/or pure water are supplied to the preparation tank 105 in order to prepare an alkali type developer with a preset desired concentration. In this way, an alkali type developer with a desired concentration that differs from that of the existing alkali type developer is obtained.

Furthermore, a more concrete control mechanism using the liquid amount control means 108 and liquid supply control means 109 will be described below as an example using the abovementioned latter case, i.e., a case in which an alkali type developer with a concentration that differs from that of the existing alkali type developer is prepared. Here, a case in which the alkali concentration of the existing alkali type developer is 3%, and this alkali type developer is to be converted into an alkali type developer with an alkali concentration of 2%, will be described as an example.

First, the liquid amount of the alkali type developer with a concentration of 3% inside the preparation tank 105 is measured by the liquid amount measuring means 106. At the same time, the alkali concentration of the alkali type developer (i.e. "3%") is measured by the alkali concentration measuring means 107.

Signals indicating these measured values are respectively sent to the liquid amount control means 108 from the liquid amount measuring means 106 and alkali concentration measuring means 107. On the basis of these measurement values, the liquid amount control means 108 calculate the amount by which the alkali type developer with a concentration of 3% must be reduced in order to prepare an alkali type developer with a concentration of 2%. Next, a command signal corresponding to the result of the calculation, i.e., to the amount of reduction, is outputted from the liquid amount control means 108. As a result, a specified amount of the alkali type developer with a concentration of 3% in the preparation tank 105 (in this case, ⅓ of the existing amount) is discharged from the preparation tank 105.

Next, the liquid amount of the alkali type developer with a concentration of 3% remaining in the preparation tank 105 (the liquid amount following reduction) is measured by the liquid amount measuring means 106. At the same time, the alkali concentration (i.e., "3%") of the alkali type developer is again measured by the alkali concentration measuring means 107.

These respective measurement signals are input into the liquid supply control means 109, and the amount of developer stock solution or pure water (or both) that must be supplied to the preparation tank 105 in order to prepare an alkali type developer with a concentration of 2% is calculated. On the basis of this calculated amount, the developer stock solution and/or pure water are supplied to the preparation tank 105 in accordance with a command signal from the liquid supply control means 109, so that an alkali type developer with the desired concentration of 2%, is obtained. Furthermore, in this example, an amount of pure water that is at least equal to the amount by which the abovementioned alkali type developer with a concentration of 3% was reduced is supplied to the preparation tank 105. In this case, furthermore, it is desirable that the liquid amount measuring means 106 and alkali concentration measuring means 107 measure the liquid amount and alkali concentration of the alkali type developer in a substantially continuous manner.

The alkali type developer thus prepared is fed into the working process in the working equipment from the preparation tank 105 via the piping 114, which has a pump 212 and a flow rate regulating valve 304, and which connects the preparation tank 105 and the working equipment.

For example, a range of values within ±1/1000 of the specified concentration is required as the concentration control range of the alkali type developer. Especially in the case of the abovementioned aqueous solution of TMAH, a range of values within ±1/2000 of the specified concentration (2.380±0.001 wt %) tends to be required. In the developer producing equipment 100 of the present invention, such strict concentration control can be sufficiently realized by performing the abovementioned concentration adjustment. Furthermore, since the abovementioned calculation/control is accomplished by automatic control performed by the control system, there is little loss of time, so that a quick concentration adjustment of the alkali type developer is possible.

Furthermore, since the abovementioned concentration adjustment can be performed, alkali type developers of various required concentrations can easily be produced on the use side, where the working equipment is disposed. Accordingly, the manufacture of electronic circuit boards for semiconductor devices and the like in small lots of various types can be handled in an adaptable and flexible manner.

Furthermore, a filter 213 is installed as a filtration mechanism after the pump 212 in the piping 114. There is a possibility that particles originating in the driving of the pump 212 or piping system, particles originating in the developer stock solution and particles originating in dust (inorganic substances or organic substances) from outside the apparatus or the like may be admixed with the alkali type developer that is fed in from the preparation tank 105. The filter 213 is used to remove such particle components admixed with the alkali type developer.

Such particles in the alkali type developer may cause developing problems during the development of electronic circuit boards or the like in the working equipment. If this happens, there is a danger that patterning defects or the like may occur. Accordingly, in the case of alkali type developers that are used in developing processes for electronic circuit boards, it is usually required that the number of particles with a diameter of 0.1 $\mu$m or greater be subject to a limit (control value) of 10 or fewer particles per milliliter of alkali type developer. Consequently, a material with a filtration function that can accommodate such a standard is appropriately selected as the filter material of the filter 213; examples of such including woven and nonwoven fabrics, and filtration membranes.

Furthermore, particle number measuring means 211 that are used to measure the number of particles contained in the alkali type developer are installed after the filter 213 in the piping 114. As was described above, most of the particles contained in the alkali type developer that is fed from the preparation tank 105 can be removed by the filter 213. The particle number measuring means 211 are used to judge whether or not the particle concentration in the alkali type developer that is thus filtered satisfies the control value.

Here, any alkali type developer that contains particles exceeding the specified control value even after passing through the filter 213 is returned to the preparation tank 105 via separate piping, and is again filtered by the filter 213 via the piping 114. As a result, the particle concentration in the alkali type developer can be securely suppressed to a fixed value or less.

In addition, dissolved gas removal means 214 are installed in the after-stage in the piping 114. Generally, gases such as oxygen gas, nitrogen gas and the like may dissolve in the alkali type developer. When such gases dissolve in the alkali type developer, gas bubbles may be generated when the alkali type developer is used in an electronic circuit board manufacturing process, so that the developing function of the developer tends to drop. On the other hand, in the developer producing equipment 100, such dissolved gases are removed by the dissolved gas removal means 214.

Here, there are no particular restrictions on the dissolved gas removal means 214, as long as these means are capable of removing dissolved gases present in the alkali type developer. For example, a device that vaporizes dissolved gases in the solution using a vacuum effect, or a degassing device using a gas-liquid separating membrane may be used.

Moreover, wet nitrogen gas sealing means 209 to which nitrogen gas and pure water are supplied are connected to the preparation tank 105 via piping 210. Furthermore, the developer stock solution tank 101 is also connected to the wet nitrogen gas sealing means 209 by a branch pipe from the piping 210.

As was described above, when the alkali type developer contacts the outside air (atmosphere), the alkali type developer absorbs and reacts with oxygen gas, carbon dioxide gas and the like contained in the air, so that the alkali type developer may show a deterioration in properties (liquidity). On the other hand, dry nitrogen gas does not undergo any substantial reaction with the alkali type developer. However, if dry nitrogen gas and the alkali type developer come into contact with each other, the moisture in the alkali type developer evaporates, leading to a rise in the alkali concentration of the solution.

On the other hand, the interior of the preparation tank 105 which is connected to the wet nitrogen gas sealing means 209 in which wet nitrogen gas is obtained, is sealed by wet nitrogen gas via the piping 210; accordingly, the abovementioned deterioration in the liquidity of the alkali type developer and rise in the alkali concentration are effectively prevented. Furthermore, since the developer stock solution tank 101 is also similarly sealed by wet nitrogen gas, deterioration in the liquidity of the developer stock solution and a rise in the alkali concentration of this solution are effectively prevented.

Here, in regard to the concrete conditions of the wet nitrogen gas, the pressure of this gas may be maintained at (for example) approximately 100 to 200 mmAq.

Thus, since deterioration in the liquidity and fluctuations in the alkali concentration of the developer stock solution and the alkali type developer at the time of preparation are prevented, and since the alkali type developer following preparation is fed into the working equipment via the piping 114 in a state in which this alkali type developer is sealed off from the atmosphere, an alkali type developer in an extremely good control state can be supplied in the required amount when necessary.

Figure 2:
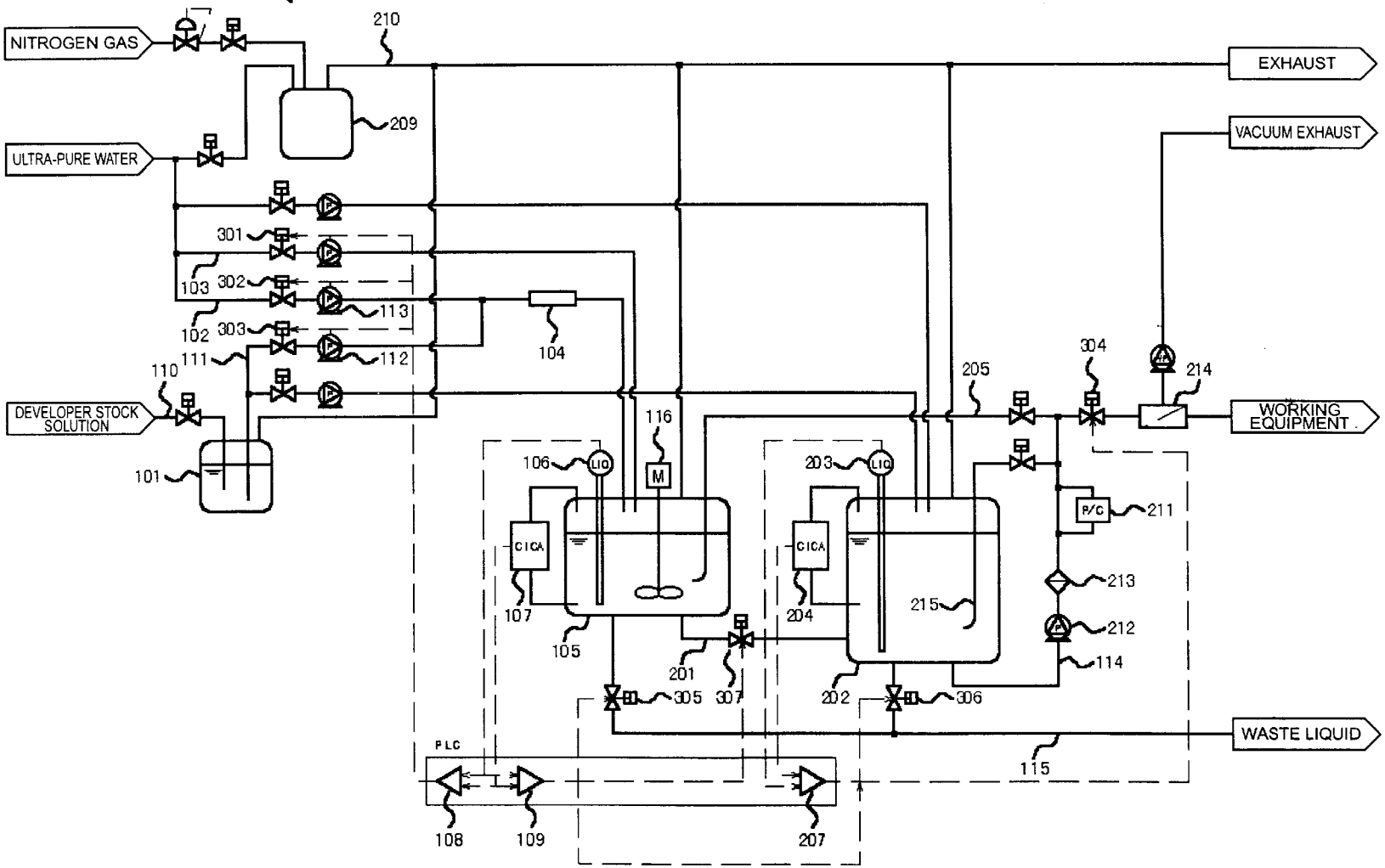
FIG. 2 is a system diagram which shows the construction of a second embodiment of the developer producing equipment of the present invention in model form.

As was described above, FIG. 2 is a system diagram which shows the construction of a second embodiment of the developer producing equipment of the present invention in model form. Except for the fact that a leveling tank 202 that is used to even out the alkali concentration of the alkali type developer is installed after the preparation tank 105, i.e., between the electronic circuit board working equipment and the preparation tank 105, this developer producing equipment 200 has a construction that is substantially similar to that of the developer producing equipment 100 shown in FIG. 1.

The leveling tank 202 is connected to the preparation tank 105 via piping 201 in which a flow rate regulating valve 307 is installed, and piping 205 (circulation feed piping) that is connected to the piping 114. Furthermore, the leveling tank 202 is connected to the working equipment via the piping 114. Moreover, the leveling tank 202 is connected to the wet nitrogen gas sealing means via the abovementioned piping 210. The leveling tank 202 is also connected to drain piping 115 in which a flow rate regulating valve 306 is installed.

Moreover, liquid amount measuring means 203 (second liquid amount measuring means) that are similar to the liquid amount measuring means 106, and alkali concentration measuring means 204 (second alkali concentration measuring means) that are similar to the alkali concentration measuring means 107, are installed in the leveling tank 202. These liquid amount measuring means 203 and alkali concentration measuring means 204 are connected to liquid amount control means 207 (second liquid amount control means) which have a control function similar to that of the liquid amount control means 108. These liquid amount control means 207 are connected to the liquid amount control means 108 and liquid supply control means 109.

Furthermore, the leveling tank 202 is respectively connected to the developer stock solution tank 101 and pure water supply system via the piping 111 and piping that branches from the pure water supply piping 102 and that has a flow rate regulating valve and a pump.

In the developer producing equipment 200 constructed as described above, an alkali type developer is first prepared by a continuous system or batch system in the preparation tank 105. The alkali concentration of the alkali type developer thus prepared is controlled by the alkali concentration measuring means 107; however, some error with respect to the desired concentration is unavoidably generated in each preparation. The leveling tank 202 is used in order to minimize this error.

In concrete terms, the alkali type developer is sent to the leveling tank 202 from the preparation tank 105, and the liquid amount of the alkali type developer in the leveling tank 202 is measured and controlled by the liquid amount measuring means 203. For example, the control of the liquid amount can be accomplished by controlling one or both of the liquid volume or liquid weight of the alkali type developer.

Furthermore, the alkali concentration of the alkali type developer in the leveling tank 202 can be measured and controlled by the alkali concentration measuring means in the preparation tank 105; however, it is desirable that this control also be performed by the alkali concentration measuring means 204 in the leveling tank 202 in order to realize much more precise concentration control.

In cases where the alkali concentration of the alkali type developer in the leveling tank 202 is found to differ from the desired concentration by an amount exceeding the permissible amount of error as a result of measurement by the alkali concentration measuring means 204, the alkali type developer in the leveling tank 202 is fed back into the preparation tank 105 again via the piping 205. The alkali concentration of the alkali type developer that is thus fed back into the preparation tank 105 is again adjusted to the desired value in the preparation tank 105, and again fed into the leveling tank 202 via the piping 201.

Furthermore, in the leveling tank 202, control of the liquid amount of the alkali type developer is performed by the liquid amount control means 207 on the basis of the measurement signals from the liquid amount measuring means 203 and alkali concentration measuring means 204. Furthermore, the control of the liquid amount of the alkali type developer in the leveling tank 202 in this case is substantially the same as that performed in the abovementioned preparation tank 105; accordingly, a detailed description is omitted here in order to avoid redundant description.

The alkali type developer that is discharged from the leveling tank 202 as a result of liquid amount control may be fed into the developing process of the working equipment via the piping 114 in the same manner as in the developer producing equipment 100 shown in FIG. 1; alternatively, this alkali type developer may be discharged to the outside of the apparatus via the piping 115, or may be fed back into the preparation tank 105 via the piping 205. Considering the effect on the environment, it is desirable that this alkali type developer be fed into the working equipment or the preparation tank 105. The alkali type developer that is fed back into the preparation tank 105 is again fed into the leveling tank 202 after the concentration is adjusted in the preparation tank 105 in the same manner as described above.

Furthermore, the measurement signals from the liquid amount measuring means 203 and alkali concentration measuring means 204 may also be sent to the liquid amount control means 108 and liquid supply control means 109. As a result, even if the function of the preparation tank 105 suffers from some kind of trouble so that this function is lost, a concentration adjustment similar to that performed in the preparation tank 105 can be performed in the leveling tank 202. Furthermore, the adjustment of the concentration of the alkali type developer in the leveling tank 202 in this case is substantially similar to the measurement and control performed in the abovementioned preparation tank 105; accordingly, a detailed description is omitted here in order to avoid redundant description.

Furthermore, it is also desirable to install agitating means (second agitating means) similar to the agitating means 116 in the leveling tank 202. If this is done, the alkali concentration of the alkali type developer in the leveling tank 202 can be evened out more quickly. A method similar to that used for the mixture in the abovementioned preparation tank 105 can be used as the agitation method for the alkali type developer here; considering the generation of bubbles and the like in the alkali type developer, it is desirable to use circulation type agitation or jet stream rotation type agitation.

Furthermore, particle components are sufficiently removed by the filter 213 from the alkali type developer that is fed out to the working equipment after the alkali concentration of this alkali type developer has been evened out by the leveling tank 202; however, if the evening out of the alkali concentration in the leveling tank 202 is taken into account, circulation filtration is desirable in the developer producing equipment 200.

Furthermore, it is desirable that the developer producing equipment 200 be equipped with liquid feed/liquid surface level control means that are used to feed the alkali type developer into the leveling tank 202 from the preparation tank 105, and to maintain the liquid surface levels in the preparation tank 105 and leveling tank 202 at substantially constant values.

The alkali type developer whose alkali concentration has been evened out by the leveling tank 202 is fed into the working equipment via the piping 114; as a result, the amount of liquid inside the leveling tank 202 decreases. In order to replenish the amount of decrease in this alkali type developer so that the amount of liquid in the leveling tank 202 is maintained at a more or less constant value, an alkali type developer with a newly prepared alkali concentration is fed in from the preparation tank 105.

Here, for example, in cases where the alkali type developer is prepared by a batch system in the preparation tank 105, means that forcibly feed the liquid, such as a pump (not shown in the figures), may be installed in the piping 201 that feeds the alkali type developer into the leveling tank 202 from the preparation tank 105 as the abovementioned liquid feed/liquid surface level control means.

On the other hand, in cases where the alkali type developer is prepared by a continuous system in the preparation tank 105, piping which has means that forcibly feed the liquid (such as a pump or the like.) in the same manner as in the case of the abovementioned batch system, or communicating piping that naturally feeds the alkali type developer into the leveling tank 202 from the preparation tank 105, may be used. Here, the term "communicating piping" refers to piping that simply communicates between the preparation tank 105 and the leveling tank 202, without being equipped with mechanical means such as a pump or the like. In this sense, the piping 201 can function as the liquid feed/liquid surface level control means.

If such communicating piping is used, then the alkali type developer inside the preparation tank 105 is naturally fed into the leveling tank 202 as a result of the hydraulic pressure difference between the preparation tank 105 and leveling tank 202 when the amount of alkali type developer inside the leveling tank 202 is reduced, so that the liquid levels in the preparation tank 105 and leveling tank 202 are maintained at more or less constant levels.

Furthermore, it is desirable to use such communicating piping in cases where it may be predicted that problems such as the generation of bubbles caused by disturbance of the liquid flow and the admixture of foreign matter such as dust generated by the driving of the pump or the like will occur if the alkali type developer is forcibly fed into the leveling tank 202 from the preparation tank 105 using a pump or the like.

Moreover, it is also ideal if the developer producing equipment 200 is equipped with a storage tank (not shown in the figures) which is disposed between the leveling tank 202 and the working equipment. Such a storage tank is used to store the alkali type developer that is fed from the leveling tank 202, and is connected to the leveling tank 202 via piping that has liquid feeding means such as a pump or the like, or communicating piping of the type described above.

If such a storage tank is provided, the alkali concentration of the alkali type developer that has been evened out by the leveling tank 202 can be made much more uniform. Accordingly, the adjustment precision of the alkali concentration of the alkali type developer that is fed into the working equipment can be greatly improved. Furthermore, since the amount of prepared alkali type developer that is stored can be increased, a large increase in the amount of alkali type developer used in the working equipment for electronic circuits or the like can be handled immediately. In addition, the working equipment can be operated without stopping during maintenance of the preparation tank 105 and/or the leveling tank 202.

Furthermore, a plurality of preparation tanks 105 may also be installed. The alkali concentration of the alkali type developer prepared in the preparation tank 105 is controlled to an appropriate range by the alkali concentration measuring means 107; however, as was described above, some error may be generated with respect to the desired concentration in each preparation.

On the other hand, if alkali type developers prepared in a plurality of preparation tanks 105 are fed into the leveling tank 202 at one time, the variation caused by error in the alkali concentrations generated in the respective preparation tanks 105 is canceled out in the leveling tank 202, so that a uniform alkali concentration can quickly be obtained. Furthermore, as a result of the provision of such multiple tanks, even if one of the plurality of preparation tank 105 becomes inoperable due to trouble, inspection or the like, the other preparation tanks 105 can be operated, so that the production of the alkali type developer can be continued without interruption.

Figure 3:
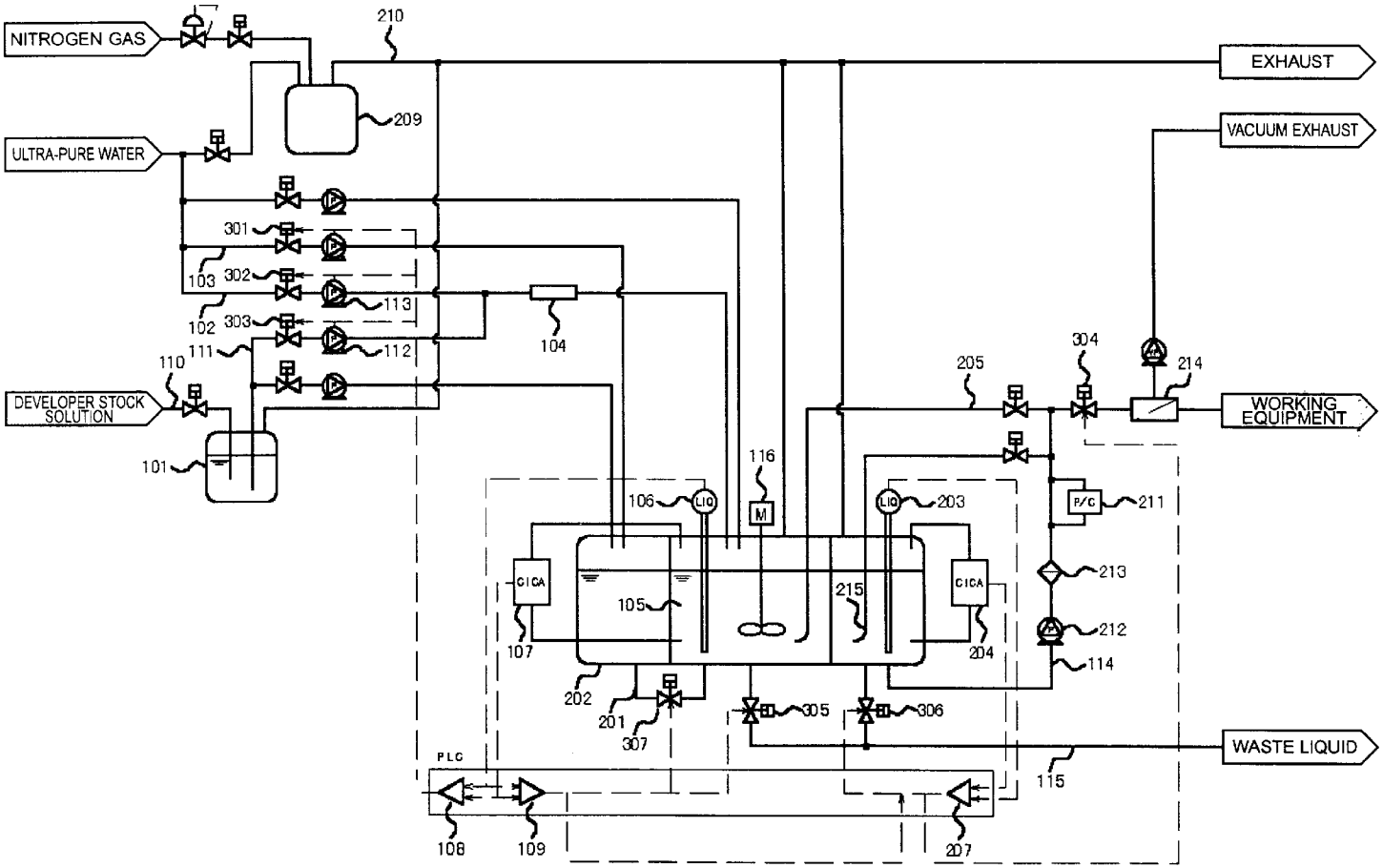
FIG. 3 is a system diagram which shows the construction of a third embodiment of the developer producing equipment of the present invention in model form.
Figure 4:
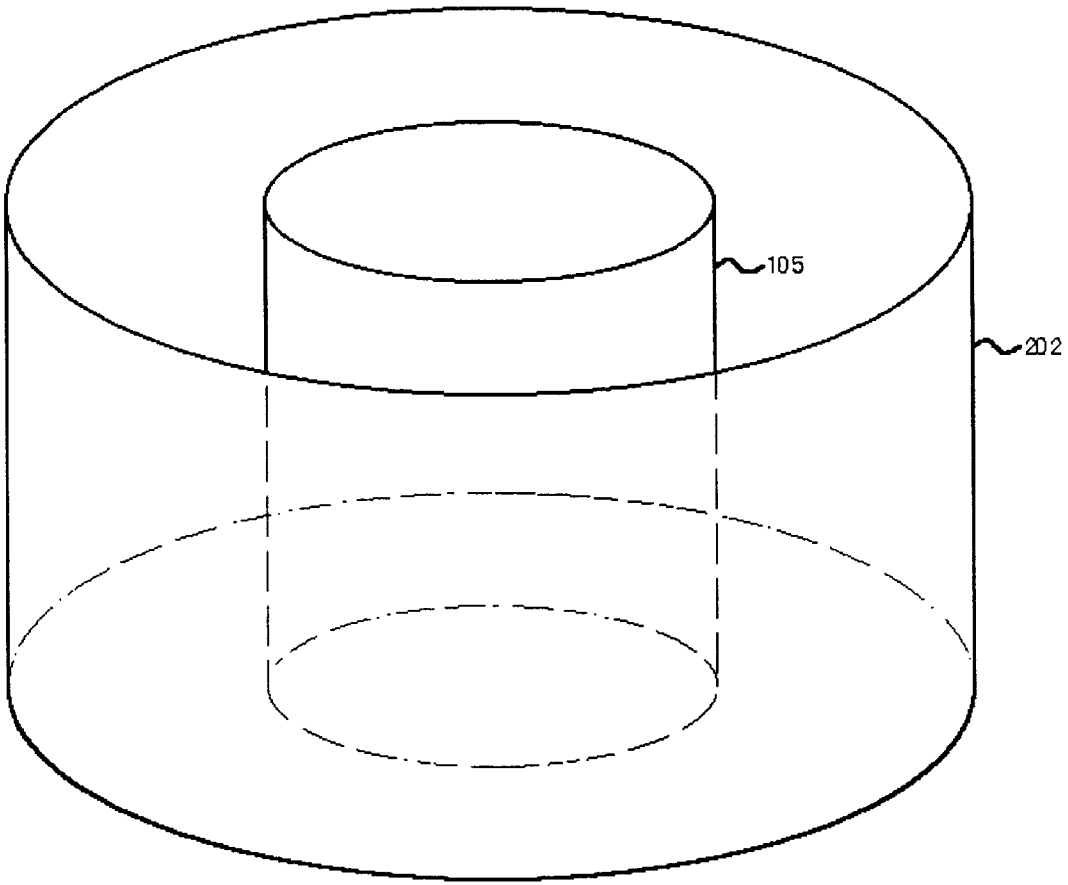
FIG. 4 is a perspective view which shows the contours of the integrated preparation tank and leveling tank shown in FIG. 3 in model form.

As was described above, FIG. 3 is a system diagram which shows the construction of a third embodiment of the developer producing equipment of the present invention. Except for the fact that the preparation tank 105 and leveling tank 202 are constructed as an integral unit, this developer producing equipment 300 is constructed so that the equipment functions in the same manner as the developer producing equipment 200 shown in FIG. 2. Furthermore, as was described above, FIG. 4 is a perspective view which shows the contours of such an integrated preparation tank 105 and leveling tank 202 in model form. As is shown in this figure, both of these tanks have a cylindrical shape, and a so-called double cylinder structure is constructed in which the preparation tank 105 is disposed coaxially inside the leveling tank 202.

By using such an integral construction, it is possible to reduce the size of the developer producing equipment 300 which is an accessory to the working equipment without having any deleterious effect on the high degree of alkali type developer production and control functionality. Accordingly, a reduction in the overall size of the working equipment, for which there has been an especially increased demand in recent years, can be accommodated.

Figure 5:
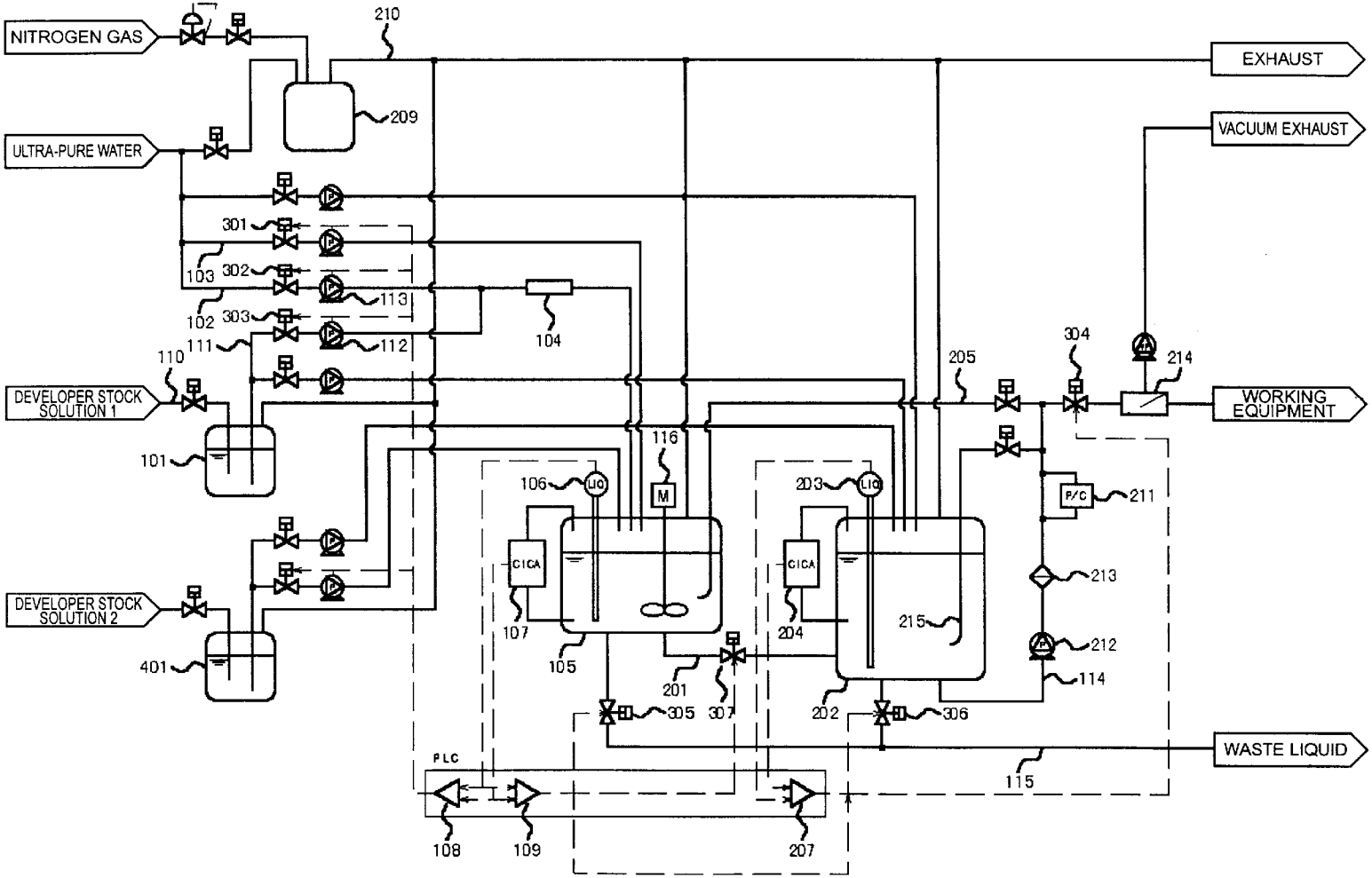
FIG. 5 is a system diagram which shows the construction of a fourth embodiment of the developer producing equipment of the present invention in model form.

As was described above, FIG. 5 is a system diagram which shows the construction of a fourth embodiment of the developer producing equipment of the present invention. This developer producing equipment 400 is constructed in the same manner as the developer producing equipment 200 shown in FIG. 2, except for the fact that a developer stock solution tank 401 which is connected to the preparation tank 105 and leveling tank 202 via independent piping that has a flow rate regulating valve and a pump is further provided. This developer stock solution tank 401 is supplied with a developer stock solution 2 that has a different concentration from that of the developer stock solution 1 supplied to the developer stock solution tank 101.

Generally, the alkali concentration of commonly used alkali type developers is in the range of approximately 15% to 30%; on the other hand, the alkali concentration of alkali type developers used in working equipment for electronic circuit boards and the like is 0.05% to 2.5%. For example, in cases where TMAH is used as the alkali component of an alkali type developer, a developer with an alkali concentration of 2.38% is the main type of developer used.

In the case of the developer producing equipment 400 having the abovementioned constitution, if, for example, a developer with an alkali concentration adjusted to a value that is close to the alkali concentration of alkali type developers used in the abovementioned working equipment (e.g., 2.38% in the case of a TMAH solution) is used as the developer stock solution 2 in the developer stock solution tank 401, an alkali type developer with the desired concentration can be prepared more quickly and with better precision. Furthermore, the use of either the developer stock solution 1 or the developer stock solution 2 can be appropriately selected with a reduction in the amount of starting solution and the like being taken into account.

Furthermore, in cases where alkali type developers with extremely different alkali concentrations are prepared according to manufacturing lots or the like in the working equipment, developer stock solutions with concentrations that are close to the alkali concentrations required in the respective alkali type developers can be stored in the developer stock solution tanks 101 and 401, and the use of the alkali type developers can be switched according to the case involved. Specifically, the developer stock solutions 1 and 2 used in the developer producing equipment and method of the present invention have arbitrary alkali concentrations that are selected from a specified range of alkali concentrations.

Furthermore, in order to accommodate the manufacture of various types of electronic circuit boards or the like in small lots even more quickly, the abovementioned developer producing equipment 100, 200, 300 or 400 can be installed adjacent to or as integral parts of a plurality of pieces of working equipment in which alkali type developers with various alkali concentrations are used. Furthermore, other equipment such as the developer dilution apparatus described in the abovementioned [Japanese] Patent No. 2751849 may be installed as a pre-stage of the developer producing equipment 100, 200, 300 or 400. The installation of such a dilution apparatus allows the easy preparation of the developer 2 that is supplied to the developer stock solution tank 401.

Furthermore, it is not absolutely necessary that the liquid amount control means 108 and 207 and the liquid supply control means 109 be installed independently; a control device which has a plurality of such functions could also be used.

As was described above, the developer producing equipment and method of the present invention make it possible to produce a developer of the desired concentration quickly and with good precision from a developer stock solution on the use side where working equipment for electronic circuit boards or the like is located. The manufacture of boards of various types in small lots can be sufficiently accommodated, and the composition and concentration of the developer that is produced can be controlled with good precision.

Furthermore, as a result of these features, it is unnecessary to install on the use side equipment such as a developer stock solution dilution apparatus, or tanks or the like for the storage of alkali type developers of various different concentrations that have been prepared beforehand on the supply side. Moreover, various types of alkali type developers that are controlled with high precision and used in the manufacture of various types of electronic circuit boards or the like in small lots in accordance with recent market demands can be quickly supplied to the working equipment and manufacturing processes.

Furthermore, developer producing equipment that is installed as an accessory to working equipment can be reduced in size. Moreover, the range (dynamic range) of the alkali concentrations of the alkali type developers can be set widely. In addition, the amount of starting solution of alkali type developers can be reduced; as a result, costs can be further reduced while alleviating the burden on the environment.

What is claimed is:

1. Developer producing equipment which is connected via piping to working equipment in which electronic circuits, on which fine working is performed, are formed, and which produces an alkali type developer used in said working equipment, said developer producing equipment comprising:

a preparation tank to which a developer stock solution and pure water are supplied, and in which these ingredients are agitated so that said alkali type developer is prepared;

first liquid amount measuring means for measuring the amount of said alkali type developer inside said preparation tank;

first alkali concentration measuring means for measuring the alkali concentration of said alkali type developer inside said preparation tank;

first liquid amount control means for adjusting the amount of said alkali type developer inside said preparation tank on the basis of a measured value obtained by said first liquid amount measuring means and a measured value obtained by said first alkali concentration measuring means; and liquid supply control means for adjusting at least either the amount of said developer stock solution or the amount of said pure water, supplied to said preparation tank, on the basis of the measured value obtained by said first liquid amount measuring means and the measure value obtained by said first alkali concentration measuring means.

2. The developer producing equipment according to claim 1, further comprising a leveling tank which is disposed between said preparation tank and said working equipment, and which evens out the alkali concentration of said alkali type developer.

3. The developer producing equipment according to claim 2, wherein said leveling tank is equipped with second liquid amount measuring means for measuring the amount of said alkali type developer inside said leveling tank.

4. The developer producing equipment according to claim 2, wherein said leveling tank is equipped with second alkali concentration measuring means for measuring the alkali concentration of said alkali type developer inside said leveling tank.

5. The developer producing equipment according to claim 2, wherein said leveling tank is equipped with second liquid amount control means for adjusting the amount of said alkali type developer inside said leveling tank on the basis of a measured value obtained by said second liquid amount measuring means and a measured value obtained by said second alkali concentration measuring means.

6. The developer producing equipment according to claim 2, further comprising feed-back piping that feeds said alkali type developer inside said leveling tank back into said preparation tank.

7. The developer producing equipment according to claim 2, wherein said leveling tank is equipped with an agitation mechanism that agitates said alkali type developer inside said leveling tank.

8. The developer producing equipment according to claim 2, wherein said leveling tank is equipped with a filtration mechanism that filters said alkali type developer inside said leveling tank.

9. The developer producing equipment according to claim 2, further comprising liquid feed/liquid surface level control means for feeding said alkali type developer into said leveling tank from said preparation tank, and adjusting the liquid surface level of said alkali type developer in said preparation tank and the liquid surface level of said alkali type developer in said leveling tank.

10. The developer producing equipment according to claim 9, wherein said liquid feed/liquid surface level control means have communicating piping which naturally feeds said alkali type developer into said leveling tank from said preparation tank, and which is connected to said preparation tank and said leveling tank.

11. The developer producing equipment according to claim 2, further comprising a storage tank that is disposed between said leveling tank and said working equipment, and that stores said alkali type developer.

12. The developer producing equipment according to claim 2, further comprising wet nitrogen gas sealing means for sealing said preparation tank and said leveling tank with wet nitrogen gas.

13. The developer producing equipment according to claim 1, having a plurality of said preparation tanks.

14. The developer producing equipment according to claim 2, wherein said preparation tank and said leveling tank are constructed as an integral unit.

15. The developer producing equipment according to claim 1, further comprising particle number measuring means for measuring the number of particles contained in said alkali type developer in a state prior to the supply to said working equipment.

16. The developer producing equipment according to claim 1, further comprising dissolved gas removal means for removing dissolved gases contained in said alkali type developer.

17. The developer producing equipment according to claim 1, wherein said first liquid amount measuring means measures at least either the volume or weight of said alkali type developer.

18. The developer producing equipment according to claim 1, where in said first alkali concentration measuring means is at least one of a conductivity meter, an ultrasonic concentration meter, a liquid density meter and an automatic titration device.

19. The developer producing equipment according to claim 4, wherein said second alkali concentration measuring means is at least one of a conductivity meter, an ultrasonic concentration meter, a liquid density meter and an automatic titration device.

20. The developer producing equipment according to claim 1, wherein said developer stock solution has an arbitrary alkali concentration selected from a specified range of alkali concentrations.

21. A method for producing an alkali type developer that is supplied via piping to a working process in which electronic circuits, on which fine working is performed, are formed, said method comprising the steps of:

preparing said alkali type developer by agitating a developer stock solution and pure water;

measuring the amount of said alkali type developer;

measuring the alkali concentration of said alkali type developer;

adjusting the amount of said alkali type developer on the basis of the measured value of the liquid amount and the measured value of the alkali concentration of said alkali type developer; and adjusting at least either the amount of said developer stock solution that is supplied to the step of preparing said alkali type developer, or the amount of said pure water that is supplied to the step of developing said alkali type developer, on the basis of the measured value of the liquid amount and the measured value of the alkali concentration of said alkali type developer.

* * * * *

UNITED STATES PATENT AND TRADEMARK OFFICE

CERTIFICATE OF CORRECTION

PATENT NO. : 6,623,183 B2
DATED : September 23, 2003
INVENTOR(S) : Toshimoto Nakagawa et al.

It is certified that error appears in the above-identified patent and that said Letters Patent is hereby corrected as shown below:

Title page,
Item [73], please add the second and the third assignees:
-- Hirama Laboratories Co.; Ltd., Kawasaki (JP)
Nagase CMS Technology Co., Ltd., Tokyo (JP) --

Signed and Sealed this

Twenty-fifth Day of November, 2003

JAMES E. ROGAN
*Director of the United States Patent and Trademark Office*